US010335345B2

(12) United States Patent
Choe

(10) Patent No.: US 10,335,345 B2
(45) **Date of Patent: *Jul. 2, 2019**

(54) VIBRATION DEVICE USING SOUND PRESSURE, AND HUMAN BODY STIMULATION APPARATUS COMPRISING SAME

(71) Applicant: EVOSONIC CO., LTD., Wonju-si, Gangwon-do (KR)

(72) Inventor: Jae Yeong Choe, Wonju-si (KR)

(73) Assignee: EVOSONIC CO., LTD., Wonju-si, Gangwon-do (KR)

( * ) Notice: Subject to any disclaimer, the term of this patent is extended or adjusted under 35 U.S.C. 154(b) by 588 days.

This patent is subject to a terminal disclaimer.

(21) Appl. No.: 14/910,143

(22) PCT Filed: Aug. 8, 2014

(86) PCT No.: PCT/KR2014/007352

§ 371 (c)(1),
(2) Date: Feb. 4, 2016

(87) PCT Pub. No.: WO2015/020469

PCT Pub. Date: Feb. 12, 2015

(65) Prior Publication Data

US 2016/0235621 A1 Aug. 18, 2016

(30) Foreign Application Priority Data

Aug. 8, 2013 (KR) ..... 10-2013-0094055
May 14, 2014 (KR) ..... 10-2014-0058076

(51) Int. Cl.
*A61H 23/02* (2006.01)
*A61H 7/00* (2006.01)

(52) U.S. Cl.
CPC ..... *A61H 23/0236* (2013.01); *A61H 7/005* (2013.01); *A61H 2201/0107* (2013.01);
(Continued)

(58) Field of Classification Search
CPC ..... A61H 23/0236; A61H 7/005; A61H 2201/0107; A61H 2201/0153;
(Continued)

(56) References Cited

U.S. PATENT DOCUMENTS 6,001,072 A * 12/1999 Fujiwara ..... H04R 5/02 601/46
2002/0156402 A1* 10/2002 Woog ..... A61H 23/0236 601/46

(Continued)

FOREIGN PATENT DOCUMENTS

JP 3049007 U 5/1998
JP 2000-308849 A 11/2000

(Continued)

*Primary Examiner* — Quang D Thanh
(74) *Attorney, Agent, or Firm* — Revolution IP, PLLC

(57) ABSTRACT

A vibration device for generating vibration using sound pressure includes a cone paper damper generating vibration and a bobbin guiding a voice coil to allow the same to be stably provided. A connection member and a vibration probe are coupled at the center of the upper surface of the cone paper damper and the bobbin. The vibration device directly receives the vibration, which is generated from the cone paper damper, and transmits the vibration to the vibration probe. In addition, a human-body stimulation apparatus includes the vibration device having a cone paper damper for generating vibration and a bobbin for guiding a voice coil to allow the voice coil to be stably provided. The human-body stimulation apparatus receives a sound source using various forms of interfaces for storing or providing the sound source.

11 Claims, 6 Drawing Sheets

(52) U.S. Cl.
CPC ..... *A61H 2201/0153* (2013.01); *A61H 2201/1685* (2013.01); *A61H 2201/1692* (2013.01); *A61H 2201/501* (2013.01); *A61H 2201/5048* (2013.01); *A61H 2205/021* (2013.01)

(58) Field of Classification Search
CPC .... A61H 2201/1692; A61H 2201/5048; A61H 2201/501; A61H 2201/1685; A61H 2205/021; A61H 2201/0157; A61H 2201/0165; A61H 2201/1207; A61H 2201/1666; A61H 2201/1683
See application file for complete search history.

(56) References Cited

U.S. PATENT DOCUMENTS

| | | | | |
|---|---|---|---|---|
| 2004/0260212 | A1* | 12/2004 | Cho ..... | A61H 23/0218 601/15 |
| 2014/0018713 | A1* | 1/2014 | Elenga ..... | A61H 23/0218 601/78 |

FOREIGN PATENT DOCUMENTS

| | | | |
|---|---|---|---|
| KR | 10-0537687 | B1 | 12/2005 |
| KR | 10-2011-0128410 | A | 11/2011 |
| KR | 10-2013-0020540 | A | 2/2013 |

* cited by examiner

VIBRATION DEVICE USING SOUND PRESSURE, AND HUMAN BODY STIMULATION APPARATUS COMPRISING SAME

TECHNICAL FIELD

The present invention relates to a vibration device. More particularly, the present invention relates to a vibration device having a cone paper damper to efficiently transmit vibration using sound pressure and thereby improve the vibration efficiency for massage and stimulation, and to a human-body stimulation apparatus having the vibration device.

BACKGROUND ART

As time passes, the human body naturally goes through an aging process, which leads to pain due to the partial degradation of the body, thus leading to activity restrictions. Further, in addition to the restriction of activities related to the effects of aging, there are other causes of a restriction in the ability of the body to perform activities, such causes include: traffic accidents due to industrial and technical development, industrial accidents, sport injury, simple accidents in activity, stress, insufficient exercise and obesity, which may lead to various complications, such as brain damage, myocardial infarction, hardening of the arteries, and arthritis.

In order to treat pain, physical damage, or obesity caused by the natural aging process or by socio-cultural problems, various stimulation apparatuses as well as medicine and health functional foods have been developed and are utilized. An example of a stimulation apparatuses is a massaging device.

Generally, a massaging device is a device that stimulates the skin or the scalp while hitting or rubbing it to promote blood circulation and lipolysis and to stimulate excretion of waste from the body. Such a massaging device generates vibration or electrical stimulation using an electrical signal and applies the stimulation to the skin or the scalp. Examples of the massaging device include a low-frequency massaging device that is configured to mount an electrode on a surface of the skin to apply low-frequency current to the human body, a ultrasonic massaging device that is configured to make a ultrasonic radiating probe contact with the surface of the skin to transmit ultrasonic vibration, a massaging device using extremely low frequency or far-infrared radiation, etc.

As current technology of stimulating the human body using vibration, various methods are applied and utilized, for example, a linear stimulating method using a simple rotary vibration motor and a solenoid, a pressing method of using air pressure, a stimulator inducing muscle contraction by inputting low-frequency current, and a method of contracting the muscle using a magnetic field. However, the above-mentioned methods simply apply pressure or stimulation to the human body, and have technical limits.

For example, a vibrator using a motor may adjust the number of vibrations, but is problematic in that it is impossible to adjust an amplitude or an intensity thereof, so that its incorrect use may cause bodily damage to, and the vibrator may not rhythmically transmit the desired number of vibrations due to the structural characteristics thereof.

Recently, in order to solve the problems, stimulating methods using the principle of a speaker have been proposed. However, they cannot realize an intensity sufficient for a user to feel the stimulation, and thus serve simply as a sub-woofer of the speaker.

In addition, technology using a low-frequency current, technology using ultrasonic waves, and technology using a high frequency have been proposed and applied. However, the low frequency causes great inconvenience to a user, and the ultrasonic wave is problematic in that it is difficult to be directly adapted to a user's feeling and effect, and an affected area is exposed, so that a medium is required to transmit the low frequency or the ultrasonic waves. This causes a critical difficulty when in use.

A high frequency is for the purpose of generating deep heat rather than being used as the stimulation apparatus, so it causes a user to feel insecure and inherently has risk factors in terms of the characteristics of the high frequency. The high frequency is problematic in that the exposure of the affected area and the medium for the transmission are needed when in use, and a conducting plate is used to transmit power to a positive pole, thus causing great inconvenience when in use.

A low-frequency therapeutic apparatus is problematic in that low-frequency current is continuously and repeatedly applied to the skin through an electrode in the form of a low-frequency pulse, so that a user feels if he or she is receiving an electric shock, thus giving an unpleasant feeling to the user and thereby reducing treatment effect. Further, the low-frequency therapeutic apparatus is problematic in that the affected area should be exposed to attach the electrode to the skin, so that women may avoid using the apparatus.

A ultrasonic-wave apparatus for treatment and beauty care is configured such that, if a skin contact surface of a ultrasonic radiating probe comes into contact with the skin, the vibration of ultrasonic waves is propagated. However, the apparatus is problematic in that an incorrect contact of the probe with the skin does not propagate the vibration of ultrasonic waves, so that it is impossible to achieve sufficient effect, and ultrasonic waves having an output value set by a user are radiated regardless of whether the probe comes into contact with the skin, so that the vibration propagating portion of the probe generates heat by vibration when the probe is not in contact with the skin, and rises in temperature, thus causing a user to feel unpleasant, and in addition, he or she may get burned when the apparatus is used for a lengthy period of time.

Further, it is possible to implement various skin care modes using vibrators that are vibrated up and down in a magnetic-coil method. Various technologies have been proposed, which permit a galvanic massage and an iontophoresis massage using the vibrators.

However, the related art adopts a method of stimulating the skin by converting the rotating force of the vibration motor into a rectilinear motion or a cam motion. Hence, this is problematic in that it makes much noise while the power of the vibration motor is transmitted, thus causing a user of a beauty-care instrument to feel unpleasant. This is problematic in that it uses the principle of causing vibration by eccentricity, so that a force dispersed in a horizontal direction, namely, a direction parallel to a skin face is large and a force acting vertically on the skin face is small, and consequently it is difficult to effectively massage the skin.

Moreover, a device for generating a soundwave or a sound source using the principle of a speaker has been developed. However, this is problematic in that a frequency generating width is small and an intensity is also very small due to structural characteristics of a magnetic circuit and positions of a plate spring and a coil. In addition, a guide using a bearing for keeping the soundwave vibration vertical and a coil spring for maintaining elasticity are required, so that it is difficult to reduce a size of the device.

The related art is very restricted in using mode and function, so that it is difficult to effectively manage the human body.

DISCLOSURE

Technical Problem

Accordingly, the present invention is intended to provide a vibration device that is configured to efficiently transmit vibration generated using sound pressure.

Further, the present invention is intended to provide a human-body stimulation apparatus equipped with a vibration device having a cone paper damper that generates vibration using sound pressure.

Furthermore, the present invention is intended to provide a vibration device having a coupling structure for efficiently transmitting vibration, and a human-body stimulation apparatus having the vibration device.

Technical Solution

In order to accomplish the above objects, the present invention provides a vibration device, which is configured such that a vibration transmission member for transmitting vibration to an outside is coupled to a central portion of a cone paper damper that generates vibration using sound pressure. Such a vibration device is capable of efficiently transmitting vibration using the vibration transmission member that is coupled to the central portion of the cone paper damper.

In an aspect, the present invention provides a vibration device for generating vibration using sound pressure, the vibration device including a lower body being open at a top thereof, and defining an accommodation space therein; a lower bracket being open at a top and a bottom thereof, and provided in the accommodation space of the lower body; a magnetic body fixedly provided on a bottom surface of the lower body to generate a magnetic force; a bobbin provided in the lower bracket to be located above the magnetic body; a voice coil provided on an outer circumference of the bobbin to interact with the magnetic body; a cone paper damper provided on an upper surface of the bobbin, coupled to an upper surface of an edge of the lower bracket, and vertically generating vibration by interaction between the magnetic body and the voice coil; and a connection member coupled at a lower end thereof to a central portion of the cone paper damper and a central portion on the upper surface of the bobbin, and coupled at an upper end thereof with a vibration probe for stimulating a human body, thus transmitting vibration from the cone paper damper to the vibration probe.

The vibration device may further include an upper plate provided on an upper surface of the magnetic body to cause the magnetic force of the magnetic body to concentrate on the voice coil.

The vibration device may further include an upper body covering the open top of the lower body, the connection member being inserted into a center on an upper surface thereof; and an upper bracket being open at a bottom thereof, and accommodated in an internal space of the upper body to be coupled with the lower bracket, the connection member being inserted into an upper surface thereof.

The cone paper damper may include a cone paper plate provided in a shape of a plate and vertically generating vibration, and a plurality of dampers arranged along an edge of the cone paper plate to extend long in a shape of a radially curved band, with a coupling hole being formed in an end of each of the dampers to be used for screw-type fastening, wherein the dampers may be fixedly coupled between edges of the upper and lower brackets.

The connection member may be coupled at an upper portion thereof with a shaft of the vibration probe through screw-type fastening, and may be coupled at a lower portion thereof with central portions of the cone paper damper and the upper surface of the bobbin.

The vibration probe may include a locking groove along an outer circumference at a predetermined position of the shaft, the connection member may include in an upper portion thereof a coupling hole into which the shaft is removably inserted, and an elastic locking pin fixedly mounted thereto to be removably seated in the locking groove, if the shaft is detachably inserted into the coupling hole, and the lower portion of the connection member may be fastened to the central portions of the cone paper damper and the upper surface of the bobbin through the screw-type fastening.

In another aspect, the present invention provides a human-body stimulation apparatus having a vibration device that generates vibration using sound pressure.

The human-body stimulation apparatus may include a sound-source processing unit generating a soundwave from an internal or external sound source; a sound-pressure generating unit having a vibration device that receives the soundwave from the sound-source processing unit and generates vibration depending on a sound pressure; and a vibration stimulating unit having various kinds of vibration probes, and stimulating a human body by mounting any one of the vibration probes to the sound-pressure generating unit and then transmitting vibration from the vibration device to the mounted vibration probe, the vibration device including a lower body being open at a top thereof, and defining an accommodation space therein, a lower bracket being open at a top and a bottom thereof, and provided in the accommodation space of the lower body; a magnetic body fixedly provided on a bottom surface of the lower body to generate a magnetic force; a bobbin provided in the lower bracket to be located above the magnetic body; a voice coil provided on an outer circumference of the bobbin to interact with the magnetic body; an upper plate provided on an upper surface of the magnetic body to cause the magnetic force of the magnetic body to concentrate on the voice coil; a cone paper damper provided on an upper surface of the bobbin, coupled to an upper surface of an edge of the lower bracket, and vertically generating vibration by interaction between the magnetic body and the voice coil, and a connection member coupled at a lower end thereof to a central portion of the cone paper damper and a central portion on the upper surface of the bobbin, and coupled at an upper end thereof with a vibration probe for stimulating a human body, thus transmitting vibration from the cone paper damper to the vibration probe; an upper bracket being open at a bottom thereof, and accommodated in an internal space of the upper body to be coupled with the lower bracket, the connection member being inserted into an upper surface thereof; and an upper body covering the open top of the lower body, the connection member being inserted into a center on an upper surface thereof.

The vibration probe may be detachably provided on an upper portion of the connection member.

The connection member may be provided to be fastened at a lower portion thereof to a central portion of the cone paper damper and a central portion of the upper surface of the bobbin through screw-type fastening.

The sound-source processing unit may include at least one interface device to receive the sound source from at least one of a portable memory card in which the sound source is stored, an external electronic device, and wireless communication by which the sound source is downloaded.

Advantageous Effects

As is apparent from the above description, a vibration device of the present invention is advantageous in that it is provided with a cone paper damper in the shape of a plate spring, and a connection member and a vibration probe are coupled with each other to transmit vibration to the cone paper damper, thus allowing the vibration generated from a sound source to be efficiently transmitted to various vibration probes.

Further, the vibration device of the present invention is advantageous in that a vibration probe is coupled to a central portion of a cone paper damper to directly receive vibration, so that an amplitude of the vibration generated in the central portion of the cone paper damper is widest, and consequently the vibration efficiency for massage or stimulation may be improved.

Further, a human-body stimulation apparatus of the present invention is advantageous in that it employs a vibration device having a cone paper damper that generates vibration using a sound source, thus efficiently providing massage and stimulation to a human body.

Furthermore, the human-body stimulation apparatus of the present invention is advantageous in that it is provided with various kinds of vibration probes and vibration stimulating units to smoothly transmit vibration generated by sound pressure to each part of a human body, thus allowing each part of a user's body to be efficiently stimulated.

Moreover, the human-body stimulation apparatus of the present invention is advantageous in that vibration is generated using various external devices equipped with sound sources, to impart a massage function and a stimulating function to a human body, thus allowing stimulation to be offered under a smart environment using a sound source that is fit for a personal preferences or needs such as a user's health or physical constitution, and maximizing the effect of use.

BEST MODE

Embodiments of the present invention may be changed in various ways, and the scope of the present invention should not be interpreted as being limited to the following embodiments. These embodiments are merely for the purpose of assisting those skilled in the art to understand the present invention.

Hereinafter, embodiments of the present invention will be described in detail with reference to FIGS. 1 to 5.

Figure 1:
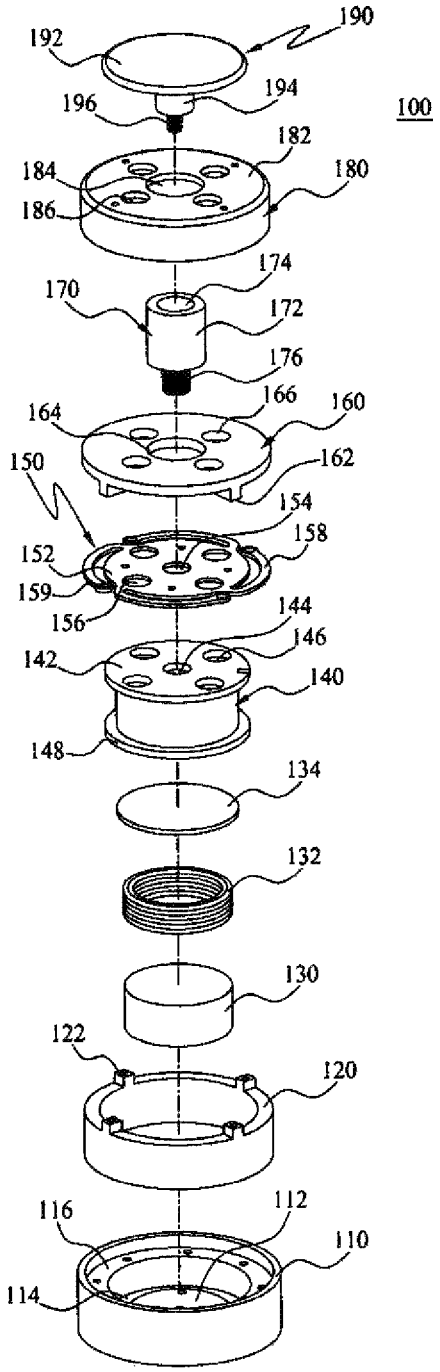
FIG. 1 is an exploded perspective view illustrating a configuration of a vibration device according to the present invention.
Figure 2:
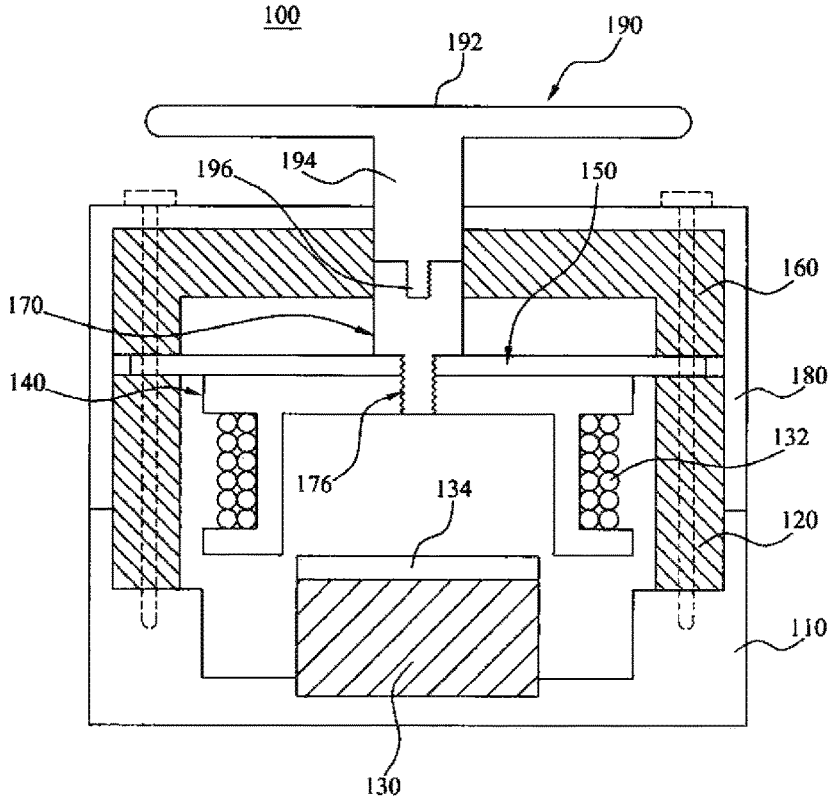
FIG. 2 is a sectional view illustrating the vibration device of FIG. 1 in an assembled state.

FIG. 1 is an exploded perspective view illustrating a configuration of a vibration device according to the present invention, and FIG. 2 is a sectional view illustrating the vibration device of FIG. 1 in an assembled state.

Referring to FIGS. 1 and 2, the vibration device 100 of the present invention includes upper and lower bodies 110 and 180, upper and lower bracket 120 and 160, a magnetic body 130, a voice coil 132, an upper plate 134, a bobbin 140, a cone paper damper 150, and a connection member 170. Although not shown in the drawings, the vibration device 100 may further include a waterproof member or a shock absorbing member.

In this embodiment, in order to transmit vibration from the vibration device 100 to an exterior thereof and thereby massage or stimulate a user's skin or scalp, the configuration of the vibration device using the connection member 170 and a vibration probe 190 will be described in detail. The connection member transmits vibration, and the vibration probe is coupled to the connection member 170 to massage or stimulate a human body.

That is, the vibration probe 190 is removably provided in the vibration device 100. The vibration probe 190 may have various shapes and sizes to be suitable for various purposes of a human-body stimulation apparatus 200 (see, FIG. 4). The vibration probe 190 of this embodiment includes a plate 192 to which a massaging or stimulating head (not shown) is detachably attached, a shaft 194 coupled to a center on a lower surface of the plate 192, and a coupling portion 196 provided on a lower end of the shaft 194 to be coupled with the connection member 170. Here, the coupling portion 196 is in the shape of a bolt that is fastened to the connection member 170 in a screw-type fastening method.

To be more specific, the lower body 110 is in the shape of a cylinder that is open at a top thereof, and defines a space in which the magnetic body 130 is installed. The magnetic body 130 is fixedly provided on a bottom surface of an internal space of the lower body 110. Further, the lower bracket 120 is installed in the lower body 110 to be fitted over the magnetic body 130 in the internal space. To this end, the lower body 110 includes a locking groove 112 that is formed on the bottom surface thereof so that the magnetic body 130 is locked thereto, a ring-shaped spacing groove 114 that is provided to be spaced apart from an outer circumference of the magnetic body 130 locked to the locking groove 112 by a predetermined interval, and a ring-shaped mounting groove 116 to which the lower bracket 120 is mounted to be spaced apart from the magnetic body 130 by a predetermined interval. The spacing groove 114 is provided to define a magnetic path of a magnetic field formed by the magnetic body 130 and the voice coil 132.

The upper body 180 is provided in the shape of a cylinder that is open at a bottom thereof and covers the open top of the lower body 110. The upper body 180 is combined with the lower body 110 to defined a space that accommodates the components 120 to 160 therein. An insertion hole 184 and a plurality of heat dissipation holes 186 are formed in an upper surface 182 of the upper body 180. The insertion hole is formed in a center on the upper surface, so that both the connection member 170 and the shaft 194 of the vibration probe 190 pass through and are inserted into the insertion hole. The heat dissipation holes are provided outside the insertion hole 184 to dissipate heat that is generated during the vibration of the vibration device 100. A waterproof member (not shown) such as, for example, silicone, may be further provided on the upper surface 182 of the upper body 180 to prevent water from passing through the insertion hole 184 into which the vibration probe 190 is inserted. The upper and lower bodies 180 and 110 are made of an aluminum material to improve a heat dissipation effect.

The lower bracket 120 is in the shape of a cylinder that is open at a top and a bottom thereof. The lower bracket 120 is mounted to the mounting groove 116 of the lower body 110, and is coupled at an upper surface thereof with the cone paper damper 150. To this end, the lower bracket 120 has on the upper surface thereof a plurality of coupling protrusions 122. The bobbin 140 equipped with the voice coil 132 is installed in the lower bracket 120. A portion of the lower bracket 120 protrudes upwards from the lower body 110. When the coupling protrusions 122 of the lower bracket 120 are coupled with dampers 158 of the cone paper damper 150, a silicone washer or the like may be used to ensure durability and maintain a vibratory force. The silicone washer may be selectively used to adjust a height of the cone paper damper 150 depending on frequency characteristics and thereby a function for efficiently maintaining an amplitude may be performed.

The upper bracket 160 is in the shape of a plate and is held in the upper body 180 in such a way that an edge thereof is coupled to the top of the lower bracket 120. A plurality of coupling protrusions 162 is provided on a lower surface of the edge of the upper bracket 160 such that both the cone paper damper 150 and the lower bracket 120 are coupled thereto.

The upper surface of the upper bracket 160 is formed in an approximately circular shape to face the lower bracket 120. An insertion hole 164 and a plurality of heat dissipation holes 166 are formed in the upper surface of the upper bracket 160. The insertion hole is formed in a center on the upper surface, so that the connection member 170 passes through and is inserted into the insertion hole. The heat dissipation holes are provided outside the insertion hole 164 to dissipate heat that is generated during the vibration of the vibration device 100. The insertion holes 184 and 164 of the upper body 180 and the upper bracket 160 serve to secure the connection member 170 and the vibration probe 190 to the central portion of the vibration device 100. A shock absorbing member (not shown), such as a plate spring, may be further provided between the upper surface of the upper bracket 160 and the upper body 180 to prevent vibration from being unnecessarily transmitted.

The magnetic body 130 is fixedly coupled to the locking groove 112 of the lower body 110, and interacts with the voice coil 132 to generate a magnetic field. The magnetic body 130 is composed of a permanent magnet of a ferromagnetic substance, such as, for example, a neodymium magnet. The upper plate 134 is mounted on the upper surface of the magnetic body 130.

The voice coil 132 is located above the magnetic body 130 to be fitted over the outer circumference of the bobbin 140. The voice coil 132 is guided to be stably installed by the bobbin 140. The voice coil 132 is supplied with power to interact with the magnetic body 130 and thereby generate a magnetic field. The magnetic body 130 and the voice coil 132 are installed in the lower bracket 120.

The upper plate 134 has a shape similar to that of the upper surface of the magnetic body 130, is provided above the magnetic body 130, and is installed to be adjacent to the lower surface of the bobbin 140. The upper plate 134 causes the magnetic force of the magnetic body 130 to concentrate on the voice coil 132, so as to prevent a loss of the magnetic field generated by the magnetic body 130. A magnetic fluid (not shown) may be applied to an outer circumference of the upper plate 134 to form the magnetic field.

The bobbin 140 is made of a material having no magnetism, for example, an aluminum material. The bobbin 140 is installed in the lower bracket 120. The bobbin 140 guides the voice coil 132 such that the voice coil is stably installed thereto and is not undesirably removed therefrom. The bobbin 140 is coupled at a center on the upper surface thereof with the connection member 170. To this end, the bobbin 140 is formed such that a side surface thereof is in the shape of a cylinder that is open at top and bottom thereof, an upper surface 142 is larger in radius than the side surface, and the bottom of the side surface extends outwards to form a lower surface 148 that is opposite to the upper surface 142. The voice coil 132 is provided on the side surface of the bobbin 140. Here, the voice coil 132 is guided by the upper and lower surfaces 142 and 148 of the bobbin 140.

Further, a coupling hole 144 is formed at a center of the upper surface 142 of the bobbin 140 to be coupled with the lower end of the connection member 170. A plurality of heat dissipation holes 146 is formed on the upper surface of the bobbin to be outside the coupling hole 144, and dissipates heat generated during the vibration of the vibration device 100. The heat dissipation holes 146 serve to reduce noise generated during the vibration, in addition to having a heat dissipation effect. Further, the bobbin 140 dissipates heat generated from the voice coil 132.

The magnetic body 130 is locked to the locking groove 112 of the lower body 110 and is disposed on an inner circumference of the lower surface 148 of the bobbin 140 to make an efficient magnetic field. Thereby, when the voice coil 132 wound around the bobbin 140 is magnetized, the bobbin 140 generates a mutual attractive force and a repulsive force to produce a stable vibratory force. In addition, the bobbin 140 is coupled with the vibration probe 190 via the connection member 170. Thus, even if physical eccentricity occurs when the vibration probe 190 stimulates a human body, a strong magnetic path created by coupling the magnetic body 130 with the upper plate 134 prevents the bobbin 140 from becoming eccentric.

The cone paper damper 150 is mounted on the upper surface 142 of the bobbin 140 to generate vibration in a vertical direction using the magnetic field generated by the interaction between the magnetic body 130 and the voice coil 132. That is, the cone paper damper 150 causes vibration generated by a sound source to vibrate the air and applies the sound of the sound source as in a speaker, thus generating the vibration. The cone paper damper 150 is coupled at an edge thereof with the upper and lower brackets 120 and 160. To this end, the cone paper damper 150 is provided with a cone paper plate 152 and a plurality of dampers 158.

The cone paper plate 152 has at the center thereof the coupling hole 154 that is coupled with the lower end of the connection member 170, with the plurality of heat dissipation holes 156 being formed outside the coupling hole 154. In order to maximize the vibratory force of the cone paper damper 150, each of the dampers 158 arranged radially from the cone paper plate 152 is formed to extend long in the shape of a curved band, and a coupling hole 159 is formed in an end of the damper to be used for screw-type fastening. The dampers 158 are fastened through the screw-type fastening method between the coupling protrusions 162 of the upper bracket 160 and the coupling protrusions 122 of the lower bracket 120 via the coupling holes 159.

In order to ensure the durability, the cone paper damper 150 is supported using elastic members, such as silicone washers, at the upper and lower portions of the coupling holes 159 of the dampers 158, thus preventing vibration from being dampened and generating a soft sound.

Therefore, the cone paper damper 150 generates vibration in response to a variation in sound pressure of the sound source supplied from the outside. The cone paper damper 150 is coupled at the central portion thereof with the connection member 170, and transmits vibration through the connection member 170 to the outside thereof, for example, the vibration probe 190. Since the amplitude of the vibration is the largest at the central portion of the cone paper damper 150, it is possible to improve vibration transmitting efficiency by fastening the bolt 176 of the connection member 170 to the coupling hole 154 of the cone paper damper 150. In the vibration device 100 according to this embodiment, in order to increase a coupling force with the connection member 170, the connection member 170 is coupled to the center of the upper surface 142 of the bobbin 140 and the cone paper damper 150.

The connection member 170 receives vibration directly from the cone paper damper 150 and then transmits the vibration to the outside. In this embodiment, the connection member 170 is coupled with the shaft 194 of the vibration probe 190. That is, the connection member 170 is provided in the shape of a shaft, is coupled at the upper portion thereof with the shaft 194 of the vibration probe 190, and is coupled at the lower portion thereof with the cone paper damper 150 and the upper surface 142 of the bobbin 140.

To this end, the connection member 170 includes a shaft-shaped body 172, a coupling hole 174 that is formed in an upper portion of the body 172 so that the shaft 194 is coupled thereto, and a fastening bolt 176 that is provided on a lower portion of the body 172 to be fastened to both the coupling hole 154 of the cone paper damper 150 and the coupling hole 144 of the bobbin 140. In this embodiment, the interior of the coupling hole 174 has a structure to which the coupling portion 196 of the shaft 194 is fastened through the screw-type fastening method.

Therefore, the vibration device 100 of the present invention is configured such that the shaft 194 of the vibration probe 190 is inserted into the center of the upper body 180 to be coupled with the connection member 170, and the connection member 170 is inserted into the upper bracket 160 to be fastened to the central portions of the cone paper damper 150 and the bobbin 140 through the screw-type fastening method. Thus, the vibration device 100 transmits vibration through the connection member 170 coupled to the cone paper damper 150 to the vibration probe 190, if the cone paper damper 150 vertically generates vibration by the sound pressure.

Figure 3A:
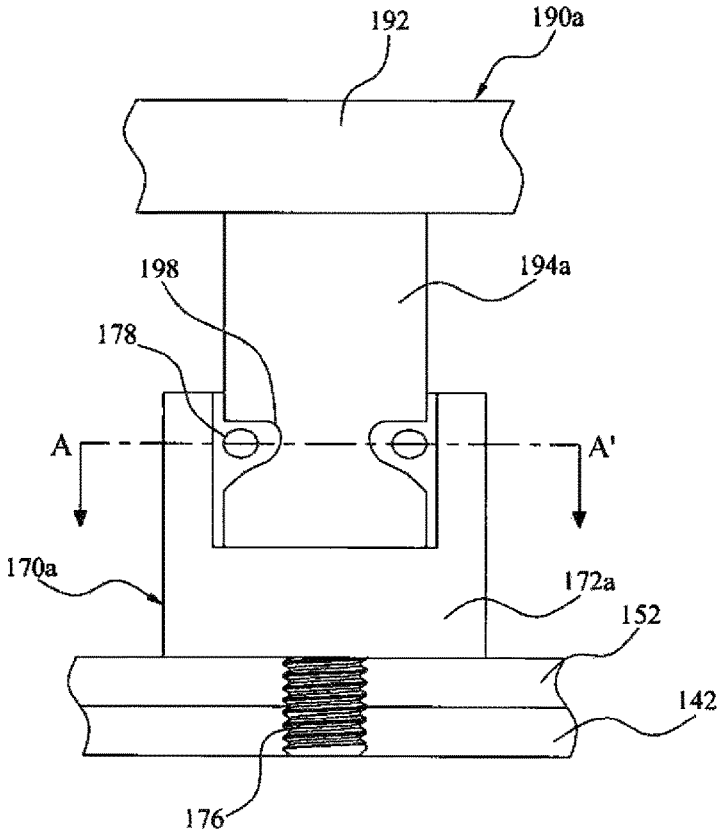
FIGS. 3*a* and 3*b* are views illustrating another embodiment of a connection member shown in FIG. 1 in an assembled state.
Figure 3B:
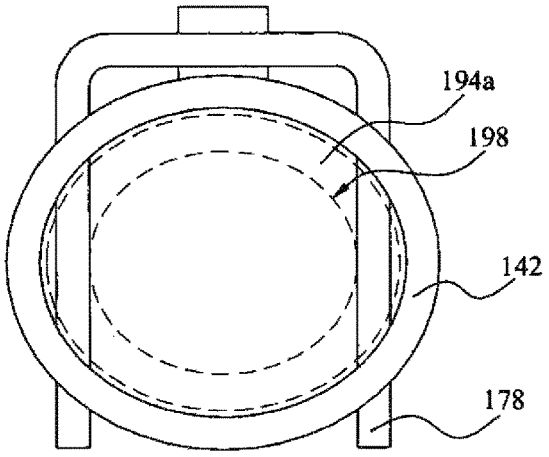

Another embodiment of the connection member 170 is shown in FIG. 3. That is, FIGS. 3*a* and 3*b* are views illustrating an assembled state of another embodiment of the connection member shown in FIG. 1.

Referring to FIGS. 3*a* and 3*b*, in this embodiment, a vibration probe 190*a* has a locking groove 198 that is formed at a predetermined position on an outer circumference of the shaft 194*a*. For example, the locking groove 198 may be formed on an outer circumference of a portion at which the shaft 194*a* of the vibration probe 190*a* is inserted into the coupling hole 174 of the connection member 170*a*. The locking groove 125 has a locking step on an upper portion thereof and a guide portion on a lower portion thereof.

Further, an elastic locking pin 178 is fixedly mounted to the connection member 170*a* to be detachably inserted into the locking groove 198. The elastic locking pin 178 is fixedly coupled to an outside of the connection member 170*a*. A portion of the elastic locking pin is exposed from the coupling hole 174 of the connection member 170*a*, the exposed portion being seated in or separated from the locking groove 198 of the shaft 194*a*.

Such a connection member 170*a* is operated as follows: when the shaft 194*a* of the vibration probe 190*a* is pressed downwards to be inserted into the coupling hole 174, the elastic locking pin 178 is guided to be seated in the locking groove 198 by the guide portion of the locking groove 198, and simultaneously the elastic locking pin 178 is fixedly mounted by the locking step. Meanwhile, when the shaft 194*a* is pressed upwards to be detached from the coupling hole 174, the elastic locking pin 178 is easily removed from the locking groove 198 by the guide portion of the locking groove 198.

When comparing this embodiment with the screw-type fastening structure of FIGS. 1 and 2, the former allows the vibration probe 190*a* to be more easily coupled to or separated from the connection member 170, and prevents damage to the coupling portion 196 of the vibration probe 190 that may occur when the vibration probe 190*a* is coupled to or separated from the vibration device 100 several times.

Therefore, since the vibration probe 190, 190*a* of the present invention employs the connection member 170, 170*a* that is coupled either by the screw-type fastening method or by using the locking groove 198 and the elastic locking pin 178, assembly during manufacture is easy.

As described above, the vibration device 100 of the present invention is configured such that the connection member 170, 170*a* and the shaft 194, 194*a* of the vibration probe 190, 190*a* are coupled to the central portion of the cone paper damper 150 that generates vibration in response to a variation in sound pressure of the sound source, so that vibration is directly transmitted from the central portion of the cone paper damper 150 to the vibration device. Further, the vibration device 100 of the present invention is configured such that the connection member 170 and the shaft 194, 194*a* of the vibration probe 190, 190*a* are coupled to the center of the upper surface 142 of the bobbin 140 and the cone paper damper 150, thus increasing a coupling force with the connection member and thereby improving vibration transmitting efficiency.

In order to stably generate vibration, the vibration device 100 of the present invention is configured such that the plate-spring-shaped cone paper damper 150 includes the cone paper plate 152 having a soundwave generating function, and the dampers 158 having both a vibratory-force transmitting function and a spring function, thus improving vibration generating efficiency.

Further, although it has been described that the vibration device 100 of the present invention has the upper and lower bodies 110 and 180 and the upper and lower brackets 120 and 160, the vibration device may be implemented without the upper body 180 and the upper bracket 160 so as to further simplify the structure and improve the vibration generating efficiency and the heat dissipation effect. This is possible because the connection member 170 is coupled to the cone paper damper 150 and the upper surface 142 of the bobbin 140 and thereby a robust coupling with the vibration probe 190 is guaranteed.

Mode for Invention

Figure 4:
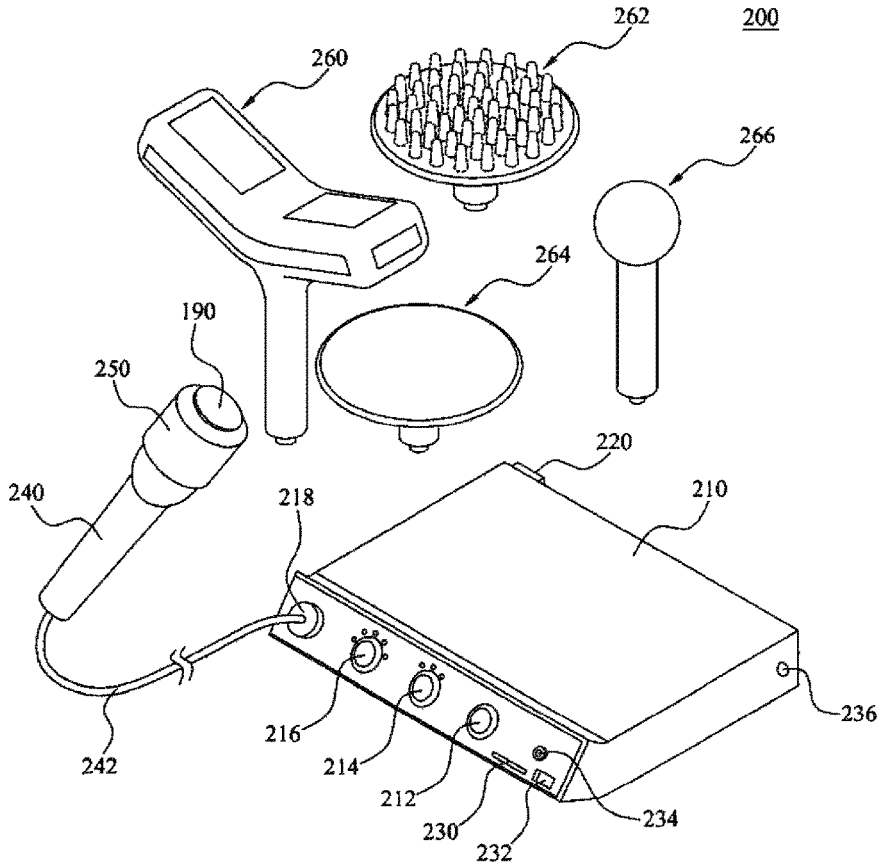
FIG. 4 is a perspective view illustrating a configuration of a human-body stimulation apparatus having a vibration device according to the present invention.
Figure 5:
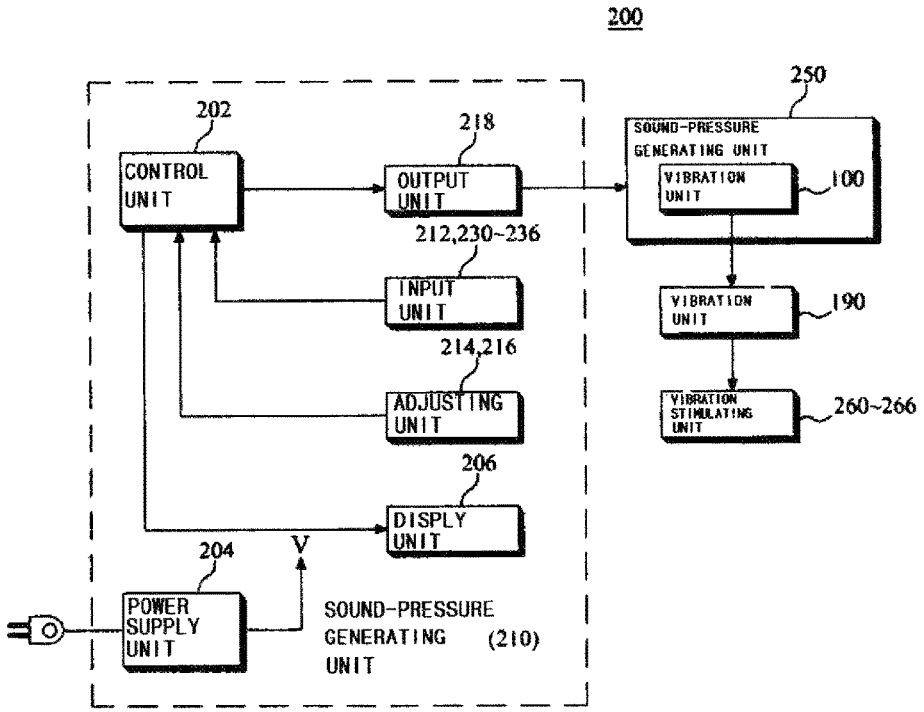
FIG. 5 is a block diagram illustrating the configuration of the human-body stimulation apparatus shown in FIG. 4.

FIG. 4 is a perspective view illustrating a configuration of a human-body stimulation apparatus having a vibration device according to the present invention, and FIG. 5 is a block diagram illustrating the configuration of the human-body stimulation apparatus shown in FIG. 4.

Referring to FIGS. 4 and 5, the human-body stimulation apparatus 200 of the present invention uses the vibration device 100 of FIG. 1 or 3 to receive vibration generated according to a change in sound pressure of a sound source, thus massaging or stimulating a human body.

To be more specific, the human-body stimulation apparatus 200 includes a sound-source processing unit 210, a sound-pressure generating unit 250 having the vibration device 100, a vibration probe 190 transmitting vibration from the sound-pressure generating unit 250 to an outside thereof, and various kinds of vibration stimulating units 260 to 266 provided to be suitable for the massaging purpose or the stimulating purpose of the apparatus.

The sound-source processing unit 210 has therein devices (not shown) for playing the sound source, e.g. a Codec, an amplifier, and a speaker, and processes the sound source so that the vibration device 100 generates vibration using the sound source. Further, the sound-source processing unit 210 outputs a soundwave signal corresponding to the sound source to the sound-pressure generating unit 250.

The sound-source processing unit 210 of this embodiment includes a control unit 202, input units 212, 230 to 236, an output unit 218, adjusting units 214 and 216, a display unit 206, and a power supply unit 204.

The input units 212, 230 to 236 include a power switch 212 supplying or interrupting power, and various interface devices inputting the sound source to the sound-source processing unit 210, for example, a memory-card input unit 230, a USB input unit 232, an AUX input unit 234, and a wireless-communication input unit 236, etc.

The memory-card input unit 230 receives various portable storage media in which the sound source is stored, for example, an SD card, a CF card, a memory stick, an MMC card and smart media to input the sound source into the sound-source processing unit 210. The USB input unit 232 is connected to an external USB device, such as an MP3, a smart phone, a personal digital assistant (PDA), a portable multimedia player (PMP) or a USB memory, to input the sound source. The AUX input unit 234 inputs the sound source using wire communication. Further, the wireless-communication input unit 236 receives the sound source with external or wireless internet using a Wi-Fi communication network, a Bluetooth wireless communication network or the like. Therefore, the sound-source processing unit 210 receives a desired sound source using various interface devices, processes the sound source and then outputs a soundwave signal.

The output unit 218 outputs the soundwave signal, generated by processing the sound source, to the sound-pressure generating unit 250. The output unit 218 is connected to the sound-pressure generating unit 250 via a connector and a connecting cable 242.

The adjusting units 214 and 216 include an intensity adjusting unit 214 provided in the form of a button or a dial knob, and a frequency adjusting unit 216. The intensity adjusting unit 214 adjusts the intensity of the sound pressure generated from the input internal or external sound source. The frequency adjusting unit 216 adjusts a key of the internal sound source, namely, a frequency.

The display unit 206 is provided, for example, in the form of a light emitting diode or a liquid-crystal display panel of the sound-source processing unit 210, to display the operational state of the sound-source processing unit 210, including a power on/off state, a sound-source playing state, and an adjusting state.

The power supply unit 204 is supplied with AC power via a power input unit 220 to supply the power V to the sound-source processing unit 210.

Further, the control unit 202 controls and treats all operations of the sound-source processing unit 210. If the power switch 212 is pushed, the control unit 202 performs control to supply power from the power supply unit 204. The control unit 202 inputs the sound source from the input units 230 to 236, and outputs the soundwave signal to the output unit 218. If the intensity or the frequency of the sound pressure is adjusted from the intensity adjusting unit 214 or the frequency adjusting unit 216, the control unit 202 treats to play the sound source in response to the adjusted intensity or frequency. The control unit 202 performs control to display the operational state of the sound-source processing unit 210 via the display unit 206.

The sound-pressure generating unit 250 is provided in the type of a handle 240, and has the vibration device 100 therein. The sound-pressure generating unit 250 receives the soundwave signal from the output unit 218 of the sound-source processing unit 210, and then generates vibration depending on a change in sound pressure of the soundwave signal using the vibration device 100. This sound-pressure generating unit 250 transmits vibration depending on the sound pressure by holding the handle 240 and making the vibration probe 190, and 260 to 266 come into direct contact with specific portions of the human body. Here, one of the various vibration probes 190 and 260 to 266 is selected and coupled to the sound-pressure generating unit 250.

The vibration probe 190 is coupled to the vibration device 100 of the sound-pressure generating unit 250 to transmit vibration to the vibration stimulating units 260 to 266.

The vibration stimulating units 260 to 266 are provided in various forms to allow the human-body stimulation apparatus 200 to massage or stimulate the human body for various purposes. The vibration stimulating units 260 to 266 are detachably mounted to the vibration device 100 of the sound-pressure generating unit 250, similarly to the vibration probe 190. The vibration stimulating units 260 to 266 are variously provided depending on a portion of the human body that is to be subjected to massaging or stimulating or an intended use, and any one of the vibration stimulating units is selected and mounted to the sound-pressure generating unit 250. The vibration stimulating units 260 to 266 may include, for example, a soundwave transmission probe 260 for electrostimulation, a vibration probe 262 for massaging the scalp, a vibration probe 264 for massaging the skin, and a vibration probe 266 for massaging the hands and feet.

Further, the vibration stimulating units 260 to 266 may be provided in the form of heads that are detachably attached to the vibration probe 190. A plurality of heads is prepared for various purposes. The heads may include, for example, a skin massaging head, a scalp massaging head, and a hand and foot massaging head. The heads may be made of various materials, such as a silicone material, a wood material, a plastic material or a metal material. Each of the heads is mounted to the vibration probe 190 and transmits vibration from the vibration device 100 to the human body to massage the skin, the scalp, and the hands and feet.

Thus, the vibration probe 190 and the vibration stimulating units 260 to 266 are coupled to the connection member 170, 170*a* of FIG. 1 or 3, and receive vibration from the cone paper damper 150 through the connection member 170, 170*a*, thus massaging and stimulating the human body.

Therefore, the human-body stimulation apparatus 200 of the present invention is intended to stimulate the skin or the scalp of the human body via various probes 190 and 260 to 266 that receive vibration from the cone paper damper 150 generating the vibration using the sound source.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the present invention provides a vibration device generating vibration via sound pressure and a human-body stimulation apparatus having the vibration device, which are able to provide massaging and stimulating functions beneficial to a human body, thereby helping improve a user's health.

The invention claimed is:

1. A vibration device for generating vibration using sound pressure, the vibration device comprising:

a lower body being open at a top thereof, and defining an accommodation space therein;

a lower bracket being open at a top and a bottom thereof, and provided in the accommodation space of the lower body;

a magnetic body fixedly provided on a bottom surface of the lower body to generate a magnetic force;

a bobbin provided in the lower bracket to be located above the magnetic body;

a voice coil provided on an outer circumference of the bobbin to interact with the magnetic body;

a damper provided on an upper surface of the bobbin, coupled to an upper surface of an edge of the lower bracket, and vertically generating vibration by interaction between the magnetic body and the voice coil;

a connection member coupled at a lower end thereof to a central portion of the damper and a central portion of the upper surface of the bobbin, and coupled at an upper end thereof with a vibration probe for stimulating a human body, thus transmitting vibration from the damper to the vibration probe;

an upper body covering an open top of the lower body, the connection member being inserted into a center on an upper surface of the upper body; and an upper bracket being open at a bottom thereof, and accommodated in an internal space of the upper body to be coupled with the lower bracket, the connection member being inserted into an upper surface of the upper bracket.

2. The vibration device according to claim 1, further comprising:

an upper plate provided on an upper surface of the magnetic body to cause the magnetic force of the magnetic body to concentrate on the voice coil.

3. The vibration device according to claim 1, wherein the damper comprises:

a plate for vertically generating vibration; and a plurality of dampers arranged along an edge of the plate extending in a shape of a radially curved band, with a coupling hole being formed in an end of each of the plurality of dampers to be used for screw fastening, and wherein each of the plurality of dampers is fixedly coupled between edges of the upper and lower brackets.

4. The vibration device according to claim 3, wherein the connection member is coupled at an upper portion thereof with a shaft of the vibration probe through the screw fastening, and is coupled at a lower portion thereof with the central portion of the damper and the central portion of the upper surface of the bobbin.

5. The vibration device according to claim 3, wherein the vibration probe comprises a shaft and a locking groove along an outer circumference at a predetermined position of the shaft, wherein the connection member comprises in an upper portion thereof a coupling hole into which the shaft is removably inserted, wherein an elastic locking pin is removably seated in the locking groove, when the shaft is detachably inserted into the coupling hole, and wherein a lower portion of the connection member is fastened to the central portion of the damper and the central portion of the upper surface of the bobbin through the screw fastening.

6. A human-body stimulation apparatus, comprising:

a sound-source processing unit generating a soundwave from a sound source;

a sound-pressure generating unit having a vibration device that receives the soundwave from the sound-source processing unit and generates vibration depending on a sound pressure; and a vibration stimulating unit having various kinds of vibration probes, and stimulating a human body by mounting any one of the vibration probes to the sound-pressure generating unit and then transmitting vibration from the vibration device to the mounted vibration probe, wherein the vibration device comprises:

a lower body being open at a top thereof, and defining an accommodation space therein;

a lower bracket being open at a top and a bottom thereof, and provided in the accommodation space of the lower body;

a magnetic body fixedly provided on a bottom surface of the lower body to generate a magnetic force;

a bobbin provided in the lower bracket to be located above the magnetic body;

a voice coil provided on an outer circumference of the bobbin to interact with the magnetic body;

an upper plate provided on an upper surface of the magnetic body to cause the magnetic force of the magnetic body to concentrate on the voice coil;

a damper provided on an upper surface of the bobbin, coupled to an upper surface of an edge of the lower bracket, and vertically generating vibration by interaction between the magnetic body and the voice coil;

a connection member coupled at a lower end thereof to a central portion of the damper and a central portion of the upper surface of the bobbin, and coupled at an upper end thereof with a vibration probe for stimulating a human body, thus transmitting vibration from the damper to the vibration probe;

an upper bracket being open at a bottom thereof, and accommodated in an internal space of an upper body to be coupled with the lower bracket, the connection member being inserted into an upper surface of the upper bracket; and the upper body covering the open top of the lower body, the connection member being inserted into a center on an upper surface of the upper body.

7. The human-body stimulation apparatus according to claim 6, wherein the vibration probe is detachably provided on an upper portion of the connection member.

8. The human-body stimulation apparatus according to claim 7, wherein the connection member is provided to be fastened at a lower portion thereof to the central portion of the damper and the central portion of the upper surface of the bobbin through screw fastening.

9. The human-body stimulation apparatus according to claim 6, wherein the sound-source processing unit comprises at least one interface device to receive the sound source from at least one of a portable memory card in which the sound source is stored, an external electronic device, and wireless communication by which the sound source is downloaded.

10. The human-body stimulation apparatus according to claim 7, wherein the sound-source processing unit comprises at least one interface device to receive the sound source from at least one of a portable memory card in which the sound source is stored, an external electronic device, and wireless communication by which the sound source is downloaded.

11. The human-body stimulation apparatus according to claim 8, wherein the sound-source processing unit comprises at least one interface device to receive the sound source from at least one of a portable memory card in which the sound source is stored, an external electronic device, and wireless communication by which the sound source is downloaded.

* * * * *